US005539442A

United States Patent [19]

Hitoshi

[11] Patent Number: 5,539,442

[45] Date of Patent: Jul. 23, 1996

[54] WAX TRANSFER TYPE THERMAL PRINTING METHOD AND APPARATUS

[75] Inventor: Saito Hitoshi, Saitama, Japan

[73] Assignee: Fuji Photo Film Co., Ltd., Kanagawa, Japan

[21] Appl. No.: 251,371

[22] Filed: May 31, 1994

[30] Foreign Application Priority Data

May 31, 1993 [JP] Japan ..... 5-129616

[51] Int. Cl.[6] ..... B41J 2/36

[52] U.S. Cl. ..... 347/183

[58] Field of Search ..... 347/171, 183, 347/188; 400/120.07, 120.09; 358/298

[56] References Cited

FOREIGN PATENT DOCUMENTS 3-219969 9/1991 Japan .

*Primary Examiner*—Benjamin R. Fuller
*Assistant Examiner*—L. Anderson

[57] ABSTRACT

Ink is transferred to an image receiving paper by a thermal head having a plurality of heating elements. The tonal level of a half tone image is expressed by the size of an ink dot recorded in a print pixel. The pixel density is changed in accordance with a smoothness of the surface of an image receiving paper and an image density. The size of a print pixel becomes large as the image density becomes low. If a high quality image receiving paper having a smooth image receiving surface is used, one ink dot per one print pixel is recorded by driving one heating element independently from the image density. If a standard paper having a round image receiving surface is used, for a highlight image area, three consecutive heating elements are driven at the same time to record a large size ink dot in a large size print pixel so as to ensure a reliable ink dot transfer. For a middle-to-high image density area, two consecutive heating elements are driven at the same time to record a middle size ink dot in a middle size print pixel. If a rough paper is used, four consecutive heating elements are driven at the same time at a highlight image area, and three consecutive heating elements are driven at the same time for a middle-to-high image density area.

13 Claims, 8 Drawing Sheets

WAX TRANSFER TYPE THERMAL PRINTING METHOD AND APPARATUS

BACKGROUND OF THE INVENTION

1. Field of the Invention

The present invention relates to a wax transfer type thermal printing method and apparatus suitable for printing a half tone image, and more particularly to a method and apparatus capable of printing a high quality image on an image receiving paper even if it has a rough image receiving surface.

2. Description of the Background

In a wax transfer type or melt-type thermal printing method, the back of an ink film (inclusive of ink ribbon) is heated by a thermal head to transfer softened or melted ink on an image receiving paper. The thermal head has a heating element array having a number of heating elements disposed in line in the main scan direction. Each heating element is driven in accordance with binary image data of an original pixel to record one ink dot per one print pixel of an image receiving paper.

In printing a half tone image by a wax transfer type thermal transfer printing method, as described, for example, in Japanese Patent Laid-open Publication No.3-219969, a current conduction time, current amplitude, the number of drive pulses, and other parameters are controlled in accordance with a tonal level of image data of an original pixel, to thereby change the length of an ink dot recorded in one print pixel in the subsidiary scan direction.

The image receiving surface of an image receiving paper used in a wax transfer type thermal transfer printing method is worked smooth so as to ensure reliable ink transfer. If an image receiving paper having a rough image receiving surface, such as a standard paper, is used, the image area where ink is transferred may have "voids" without transferred ink, thereby reducing the quality of the image. Generally, ink transfer is ensured for a half tone image having a middle density or higher even if an image receiving paper having a rough or less smooth image receiving surface is used. However, ink transfer becomes unreliable and voids are formed for a half tone image having a low density (highlight area) because of small ink dots, resulting in a coarse or granular print.

SUMMARY OF THE INVENTION

It is a principal object of the present invention to provide a wax transfer type thermal transfer printing method and apparatus capable of suppressing the generation of voids even if a half tone image having a low density area is printed on an image receiving surface of low smoothness.

In order to achieve the above and other objects of the invention, for a low density area of a half tone image, the print pixel density is lowered at least in the main scan direction to increase the size of one print pixel. With a large size of a print pixel, an ink dot elongated at least in the main scan direction is recorded in order to reproduce the density of an original pixel. Accordingly, it is possible to record an ink dot of a large size without changing the total density of the half tone image, resulting in reliable transfer of an ink dot and prevention of peel-off of an ink dot.

According to a preferred embodiment of the present invention, image data in the main scan direction is thinned in accordance with a change in the print pixel size, and the thinned image data is replaced by the remaining image data.

In this manner, at least two consecutive heating elements can be driven at the same time by the same drive data, and the size of a print pixel is made large only in the main scan direction.

According to another preferred embodiment, image data is thinned both in the main and subsidiary scan directions to leave the remaining image data corresponding in amount to a thinning ratio. Although the thinned image data is replaced by the remaining image data in the main scan direction as described above, the image data in the subsidiary scan direction is thinned and not replaced. Accordingly, the size of a print pixel is made large both in the main and subsidiary scan directions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects and advantages of the present invention will become apparent from the detailed description of the preferred embodiments when read in conjunction with the accompanying drawings, which are given by way of illustration only and thus are not limitative of the present invention and in which.

DETAILED DESCRIPTION OF THE PREFERRED EMBODIMENTS

Figure 2:
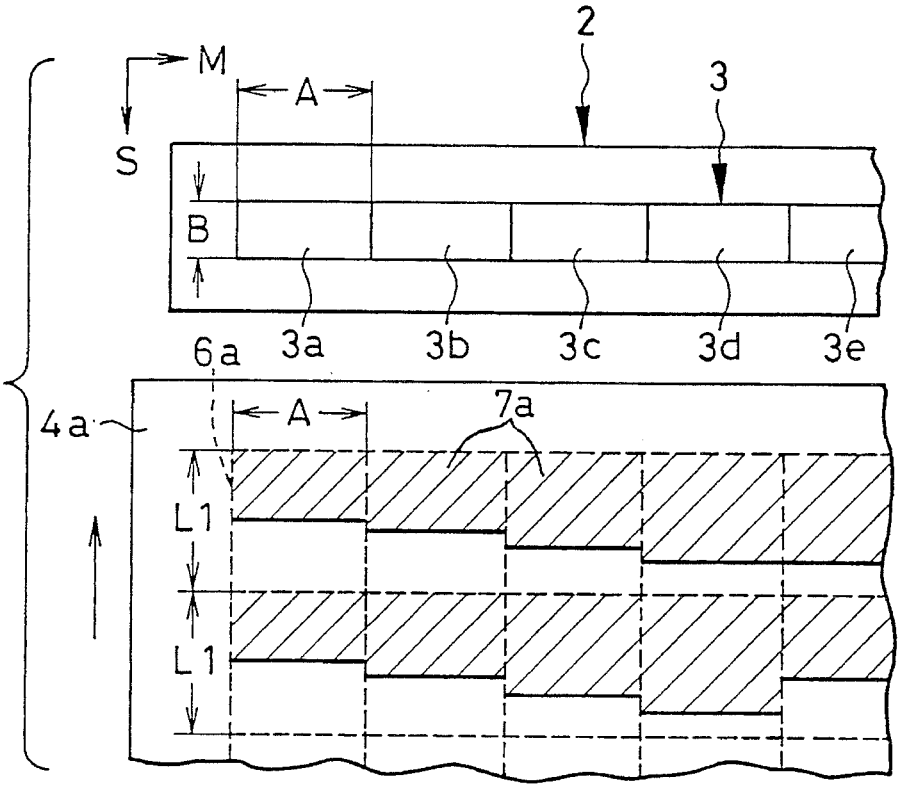
FIG. 2 is a schematic diagram of a thermal head and an example of a print formed by one-dot mode.

Referring to FIG. 2, a thermal head 2 has a heating element array 3 extending in the main scan direction M. The array 3 has a plurality of heating elements 3*a*, 3*b*, 3*c*, . . . . Each heating element is rectangular having a length A in the main scan direction M and a length B in the subsidiary scan direction S. For example, the length A is 84 microns, and the length B is 40 microns. Each heating element may be square. The length B may be set longer than the length A for the reason that a cooling efficiency of a heating element at opposite end portions in the subsidiary scan direction is low and ink cannot be transferred at a low density with a less number of heating operations.

The thermal head 2 and an image receiving paper 4 are continuously or intermittently drive in relative motion in the subsidiary scan direction S. An ink film 5 (refer to FIG. 9) is attached to the image receiving paper 4. The back of the ink film 5 is heated by the thermal head 2 to transfer melted or softened ink to the image receiving paper 4. Transferred ink forms an ink dot on a print pixel. In this embodiment, a feed pitch of the thermal head 2 is 4 microns. Each ink dot increases its length in the subsidiary direction S starting from 40 microns by an increment of 4 microns, in accordance with a tonal level of image data of each original pixel. In this manner, a half tone is expressed by an area gradation method. For example, ink is transferred 64 times to form the maximum density print pixel of the 64-th tonal level.

Figure 1:
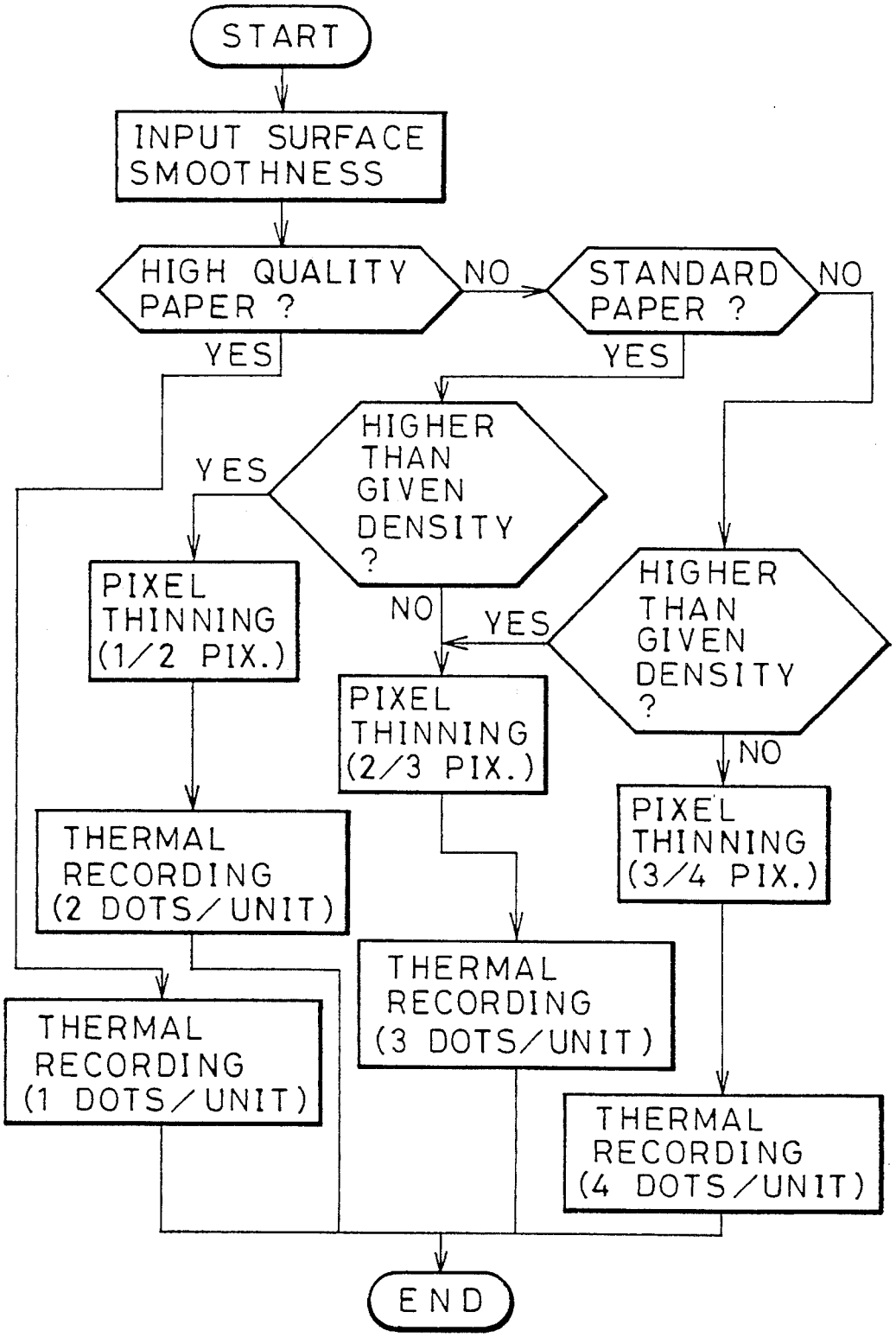
FIG. 1 is a flow chart explaining the printing method of the invention.

As shown in the flow chart of FIG. 1, the pixel density in the main scan direction M changes with the smoothness of the image receiving surface of the image receiving paper 4 and the image density. The higher the pixel density, the smaller the size of a print pixel. Each print pixel is virtually represented by a square on the image receiving paper 4.

A one-dot mode is used for a high quality paper 4*a* having a high smoothness (Bekk smoothness degree of 150 sec or longer). As shown in FIG. 2, one ink dot 7*a* is recorded in one print pixel 6*a* by using one heating element. In this case, the pixel density in the main scan direction M is 12 dots/mm. The size of the print pixel 6*a* is A×L1. The length L1 in the subsidiary scan direction S can be electrically controlled and set to a desired length. A print pixel is, in general, square, and so A=L. In this case, a print pixel is 84×84 microns, and the pixel densities in the main scan direction M and in the subsidiary scan direction S are both 12 dots/mm.

Figure 3:
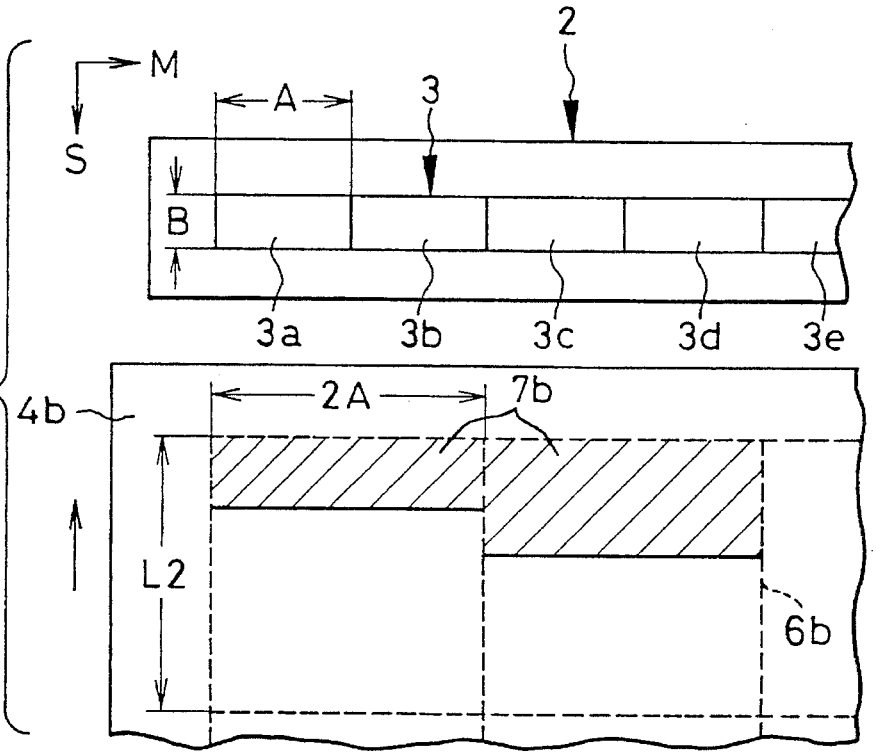
FIG. 3 is a schematic diagram of a thermal head and an example of a print formed by two-dot mode.

One of a two-dot mode and a three-dot mode is selectively used for a standard paper *4*b such as a copy sheet (Bekk smoothness degree of 40 to 100 sec) depending upon the density of a print image, i.e., the value of image data. For an image area having a middle-to-high density, the two-dot mode is used. In the two-dot mode, the heating element array 3 is grouped into sets of two consecutive heating elements as shown in FIG. 3. The two heating elements of the same group are driven at the same time by the same drive data to print one ink dot 7*b* in one print pixel 6*b*. In this case, the pixel density in the main scan direction M is 6 dots/mm. The size of a print pixel is 2A×L2 (e.g., 168×168 microns) in the main scan direction M and in the subsidiary scan direction S.

Figure 4:
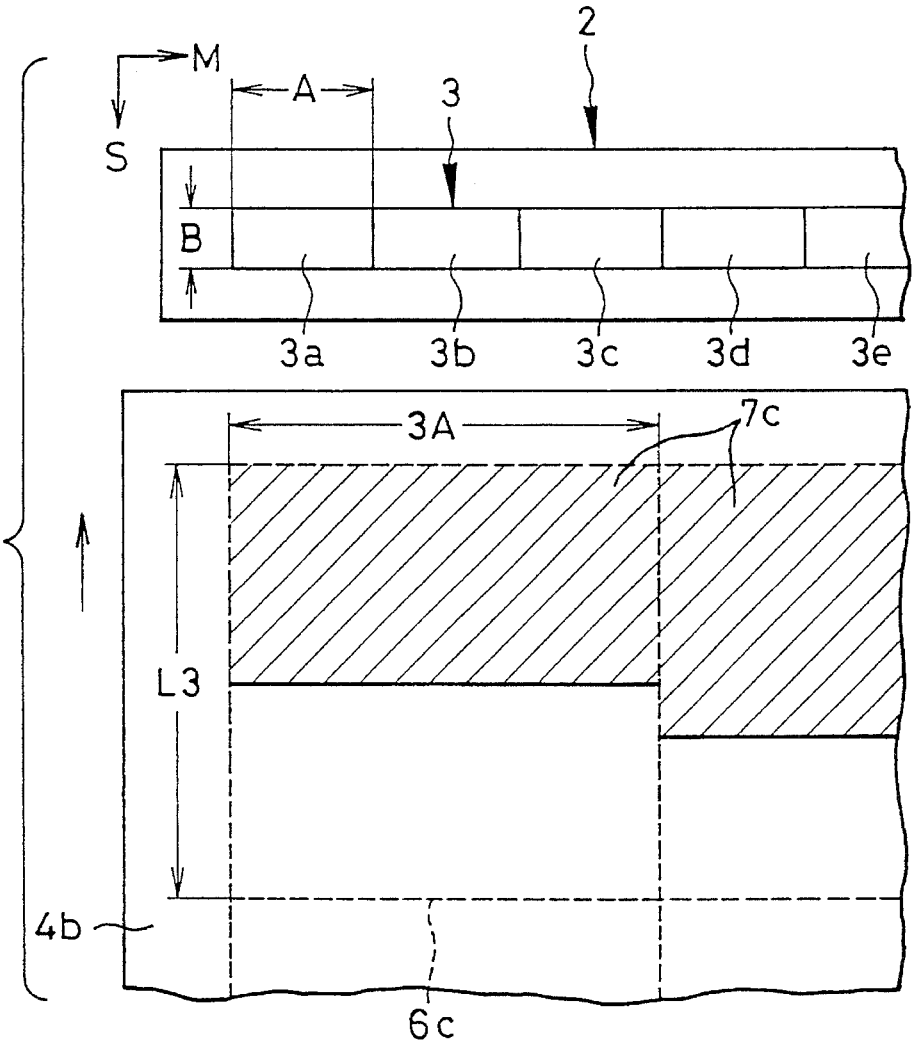
FIG. 4 is a schematic diagram of a thermal head and an example of a print formed by three-dot mode.
Figure 7:
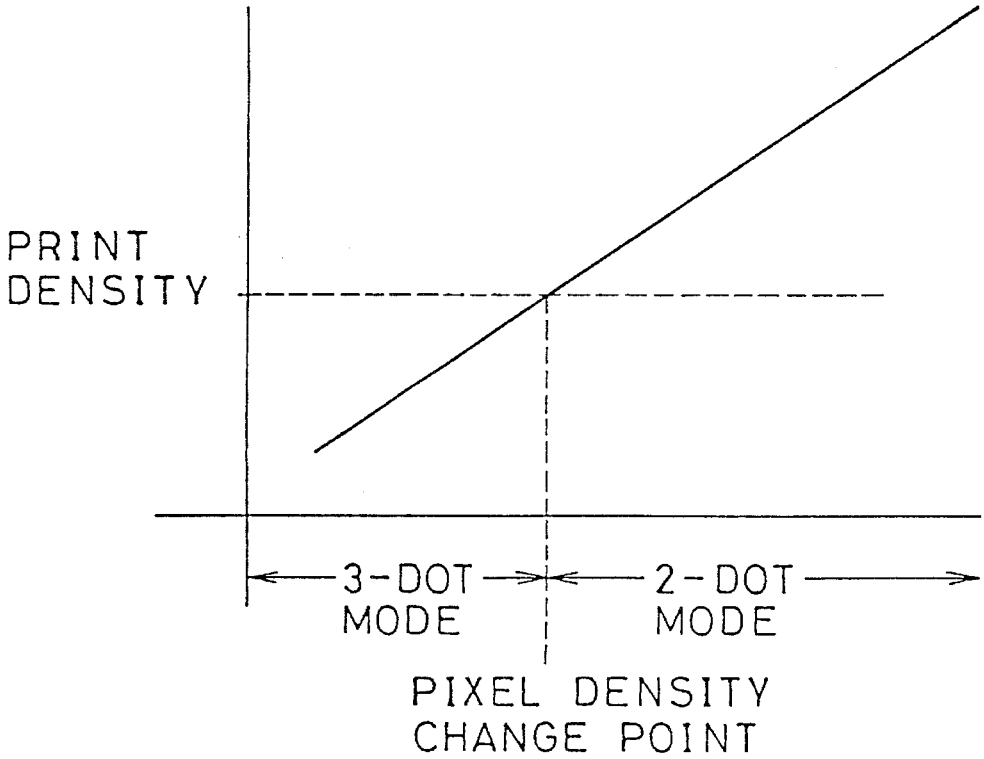
FIG. 7 is a graph showing the relationship between print density and dot mode for a rough paper.

For a highlight image area having a predetermined density or lower, the three-dot mode is used as shown in FIG. 4 and the heating element array 3 is grouped into sets of three consecutive heating elements. The three heating elements of the same group are driven at the same time to record one ink dot 7*c* in one print pixel 6*c*. The pixel density is 4 dots/mm. The size of a print pixel is 3A×L3 (e.g., 252×252 microns) in the main scan direction M and in the subsidiary scan direction S. The relationship between print density and dot mode in the case of standard paper 4*b* is shown in FIG. 7.

Figure 5:
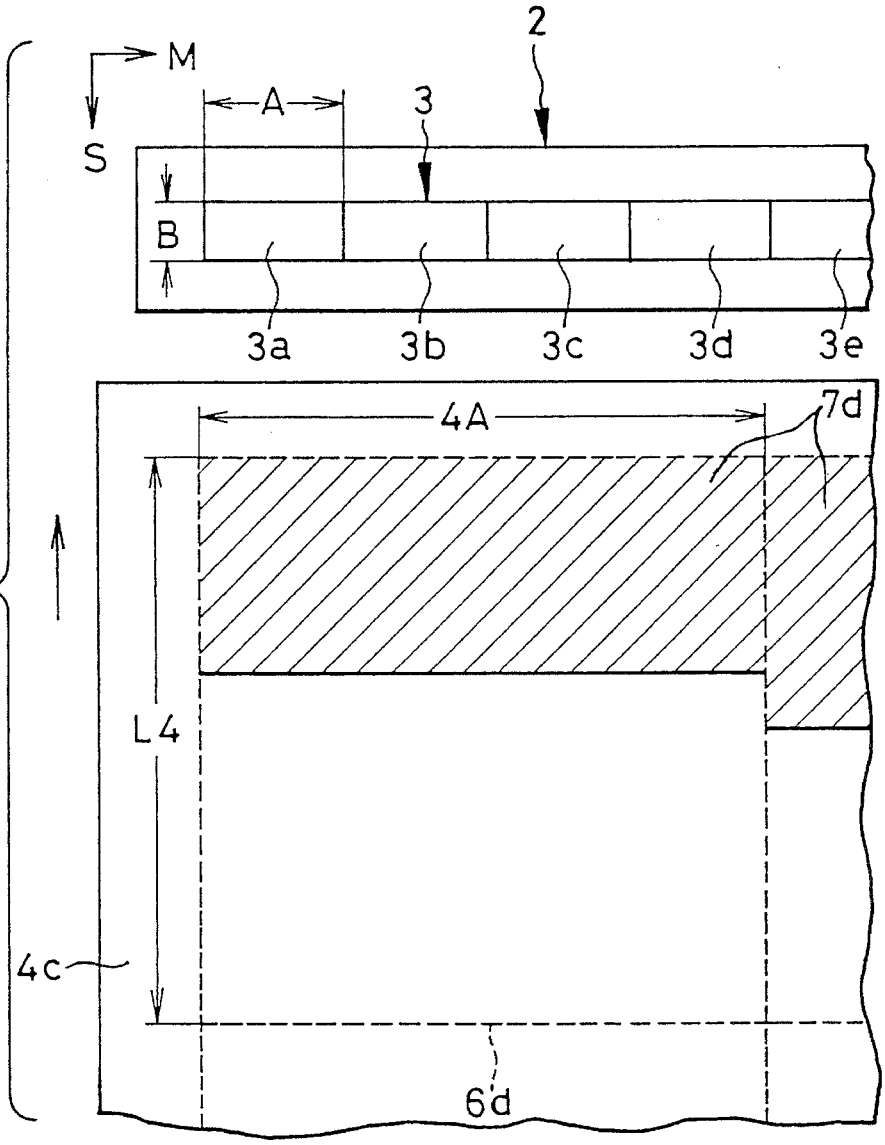
FIG. 5 is a schematic diagram of a thermal head and an example of a print formed by four-dot mode.
Figure 6:
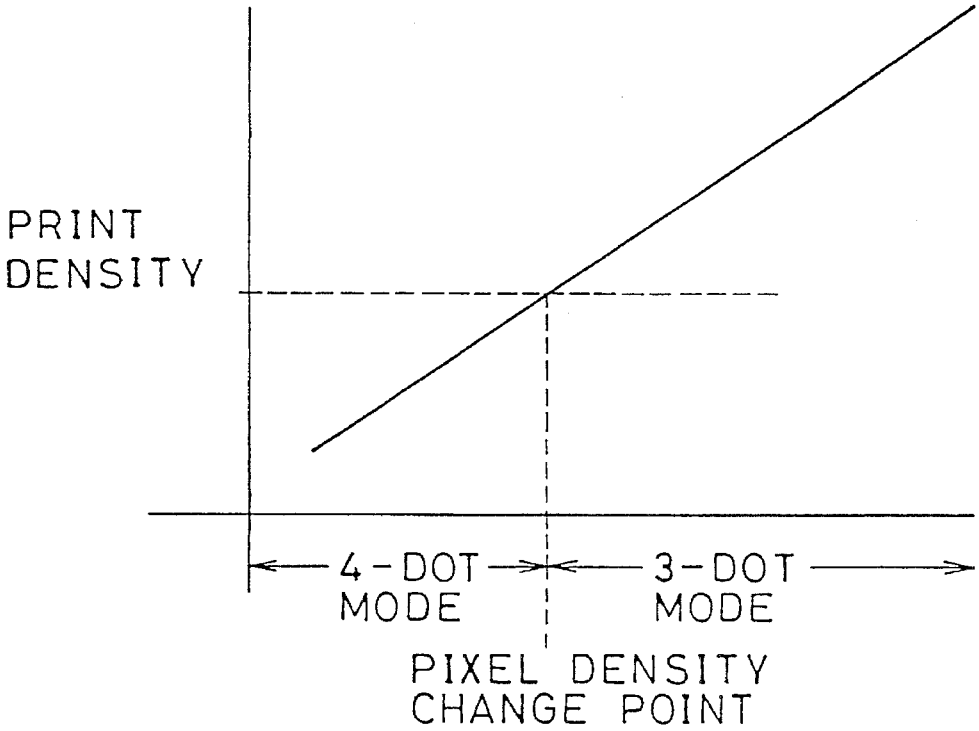
FIG. 6 is a graph showing the relationship between print density and dot mode for a standard paper.

Also when a rough paper (Bekk smoothness degree of 2 to 10 sec) such as a bond paper and a Lancaster paper is used, the record mode is selected depending on the density of an image area. For the middle-to-high density area, the three-dot mode is selected as shown in FIG. 4. For a highlight area having a predetermined density or lower, the four-dot mode is used and the heating element array is grouped into sets of four consecutive heating elements as shown in FIG. 5. The four heating elements of the same group are driven at the same time to record one ink dot 7*d* in one print pixel 6*d* on paper 4*c*. In this case, the pixel density in the main scan direction M is 3 dots/mm, and the size of a print pixel is 4A×L4 (e.g., 336×336 microns) in the main scan direction M and in the subsidiary scan direction S. The relationship between print density and dot mode in the case of rough paper is shown in FIG. 6.

Figure 8:
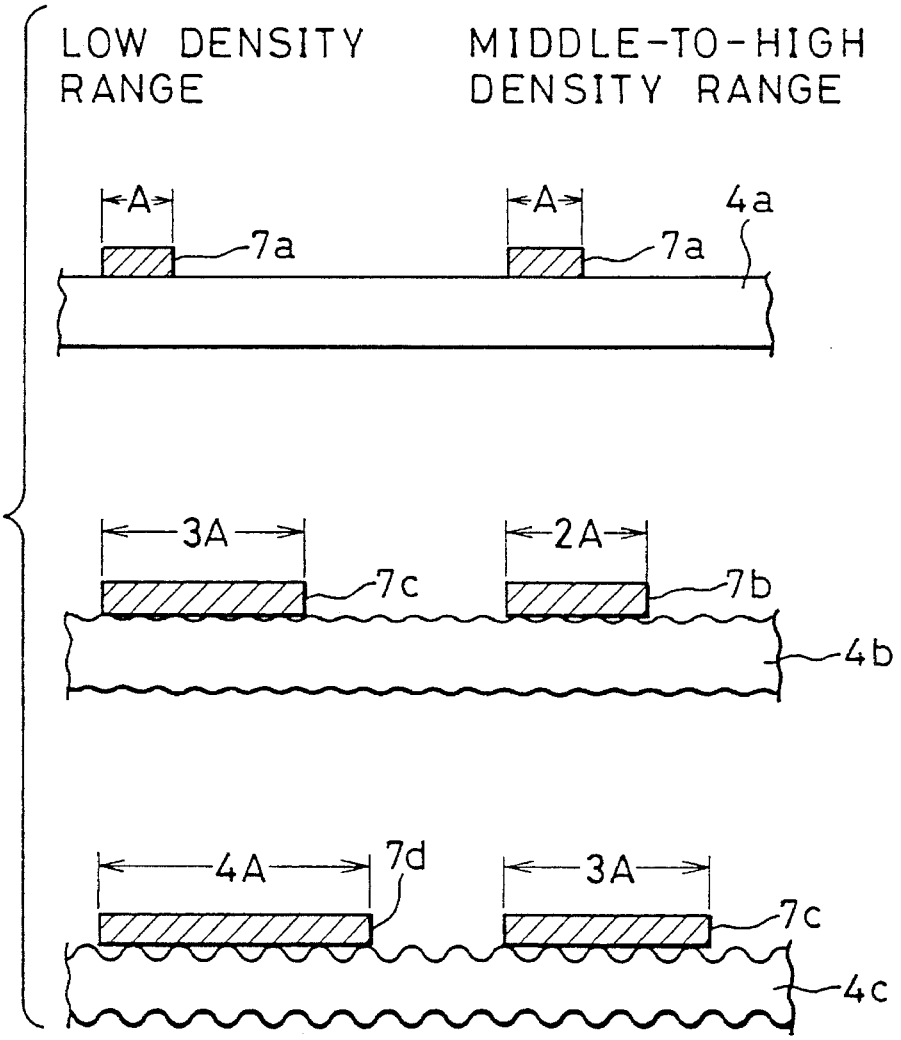
FIG. 8 are schematic diagrams explaining transfer states of ink dots on papers having various degrees of surface roughness.

FIG. 8 shows the relationship between dot mode and type of image receiving paper. In accordance with the smoothness of the image receiving surface of an image receiving paper and the density of an image, the sizes of a print pixel and an ink dot are changed. For a highlight image area using an image receiving paper having a low smoothness, the length of an ink dot becomes long in the main scan direction M so that the adherence of ink to an image receiving surface is improved, voids are not generated, and ink peel-off is avoided.

The dot mode cannot be changed within a line of print pixels of the heating element array 3 which are recorded at the same time, so that the dot mode is changed in units of line. An average density of original pixels of each line is therefore calculated to judge whether it is higher or lower than a threshold density. In practice, an average value of image data of respective original pixels is calculated to select one of two modes depending upon whether the average value is larger than a predetermined value. For example, in the two-dot mode, every second original pixel is thinned in the main scan direction M, and the remaining image data of original pixels are multiplied by two. The two-fold image data is also used as the adjacent thinned image data. The one line image data processed in this manner is a series of two image data having the same value. Since the image data is multiplied by two, the image data of original pixels of the next line is not used for printing. As a result, every second image data is thinned in the main scan direction M, and all image data at every second line is thinned in the subsidiary scan direction S.

In the three-dot mode, two of three original pixels are thinned in the main scan direction M, and the remaining image data of original pixels are multiplied by three. The three-fold image data is also used as image data of the two consecutive thinned original pixels. In the subsidiary scan direction S, all image data of two of the three lines is thinned and not used for printing.

When the two- and three-dot modes are used, one of them may be selected by checking the average density of two lines and three lines. In the one-dot mode, an average value of image data of original pixels to be printed on an image receiving paper at print pixels having a particular size may be used as print image data. In the two-dot mode, a two-fold average value of image data of four original pixels, including two pixels in the main scan direction M and two pixels in the subsidiary scan direction S, may be used for heating the adjacent two heating elements in the main scan direction M. In this case, it is obvious that image data at every second line is thinned in the subsidiary scan direction S.

Figure 9:
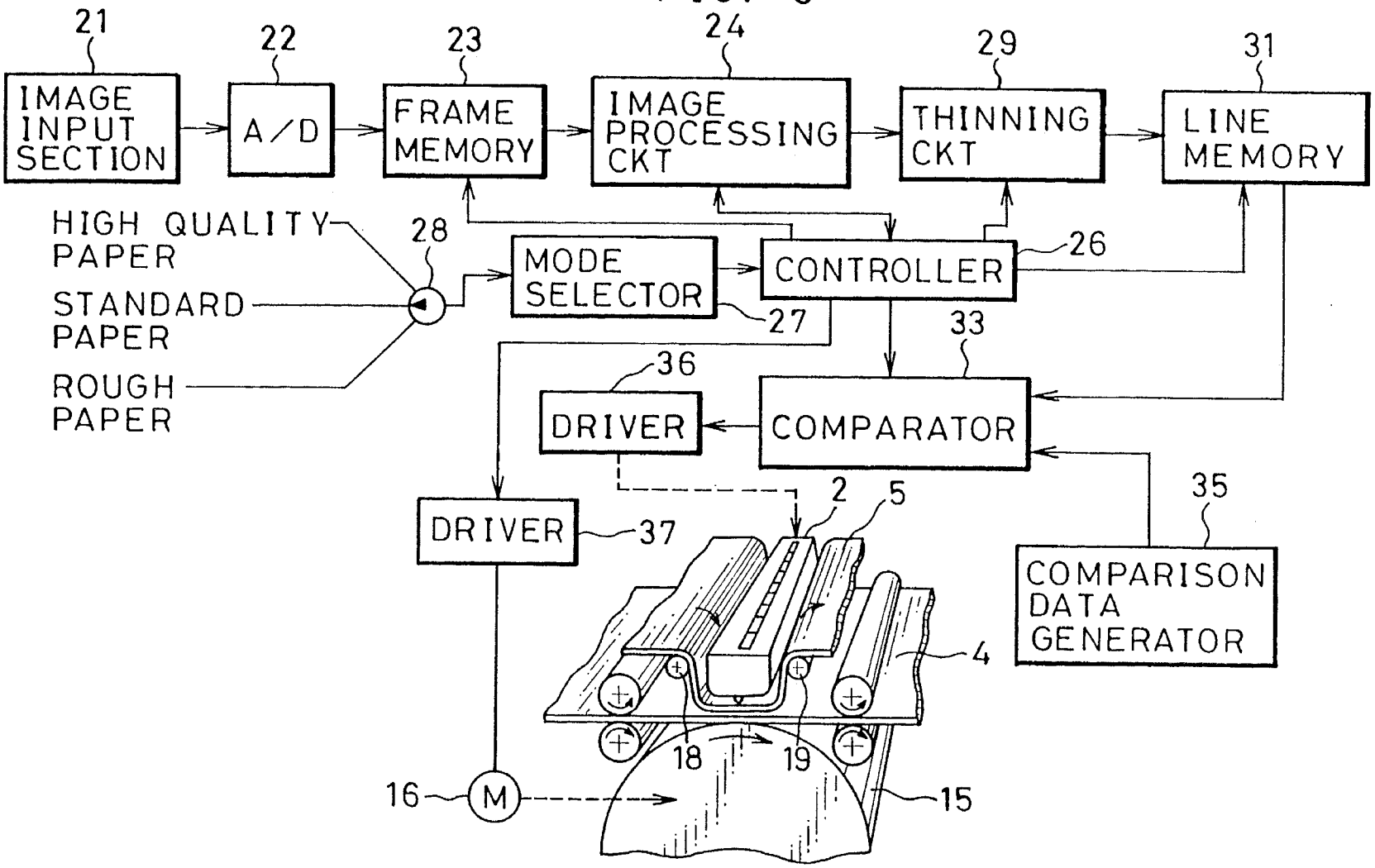
FIG. 9 illustrates the outline of a wax transfer type thermal transfer printer in blocks and partially in perspective.

FIG. 9 illustrates the outline of a wax transfer type thermal transfer printer in blocks and partially in perspective. An image receiving paper 4 contacts a platen roller 15 which is intermittently rotated at an equal pitch (4 microns) by a pulse motor 16. An ink film 5 moves along guide rollers 18 and 19 between which a thermal head 2 is disposed. The thermal head 2 heats the back of the ink film 5 whose ink layer is in tight contact with the image receiving paper 4.

An image input section 21 such as a TV camera and a scanner scans an original image and converts it into a one line image signal. This analog one line image signal is converted into a digital signal by an A/D converter 22 so that one line of the original image is divided into a plurality of original pixels which are written in a frame memory 23. In this manner, image data is written in the frame memory 23 one line after another.

The image data in the frame memory 23 is read one line after another. Each one line image data is sequentially sent to an image processing circuit 24 to be subjected to gradation correction. An average value of one line image data is calculated and sent to a controller 26 to which a mode selector 27 is connected. In response to the setting of an image receiving paper select dial 28, the mode selector 27 sends a signal to the controller 26, the signal indicating one of a high quality paper having a high smoothness, a standard paper having a middle smoothness, and a rough paper having a low smoothness. The controller 26 controls a thinning circuit 29 in accordance with the average value calculated by the image processing circuit 24 and the type of an image receiving paper inputted from the mode selector 27.

In the case of a high quality paper, the image data is sent to a line memory 31 without thinning it. In this case, similar to a conventional printing method, each image data drives a corresponding heating element to record ink dots in A×L1 print pixels.

In the case of a standard paper, if the average value exceeds the threshold value, i.e., if the density is middle-to-high, the image data is multiplied by two and thinned every second data, and the thinned data is replaced by the two-fold image data. Thereafter, the image data is written in the line memory 31. If the average density indicates a highlight image area, the image data is multiplied by three, two of three image data are thinned, and the thinned data is replaced by the three-fold image data. Thereafter, the image data is written in the line memory 31.

In the case of a rough paper, if the average value exceeds the threshold value, the image data is multiplied by three, two of three image data are thinned, and the thinned data is replaced by the three-fold image data. If the average value indicates a highlight image area, the image data is multiplied by four, three of four image data are thinned, and the thinned data is replaced by the four-fold image data.

The image data is sequentially read from the line memory 31 and sent to a comparator 33. The input of the comparator 33 is supplied with comparison data from a comparison data generator 35. The comparison data generator 35 generates comparison data corresponding to the dot mode. For example, in the case of 64 tonal levels, it sequentially generates comparison data of "0" to "63" in decimal notation in the one-dot mode, "0" to "126" in the two-dot mode, and "0" to "189" in the three-dot mode.

The comparator 33 sequentially compares the image data of one line with the comparison data supplied to the comparator 33 to convert each image data into drive data including "0" and "1". In the one-dot mode for example, one image data is compared 64 times and converted into 64-bit drive data. This drive data is sent to a driver 36 which drives the thermal head 2 to selectively power each heating element. The heating element heats the back of the ink film 5 to record a half tone image on the image receiving paper 4.

Synchronously with driving the thermal head 2, the controller 26 intermittently rotates a platen drum 15 by one step, via a driver 37 and the pulse motor 15. At each step, the heating element array 3 is driven. In the one-dot mode for example, the platen drum 15 is rotated 64 steps to record one print pixel, and the heating element turns on 64 times if the tonal level is the maximum density of "64". As the platen drum 15 rotates by the steps corresponding to the size of a print pixel, printing of one line is completed.

Figure 10:
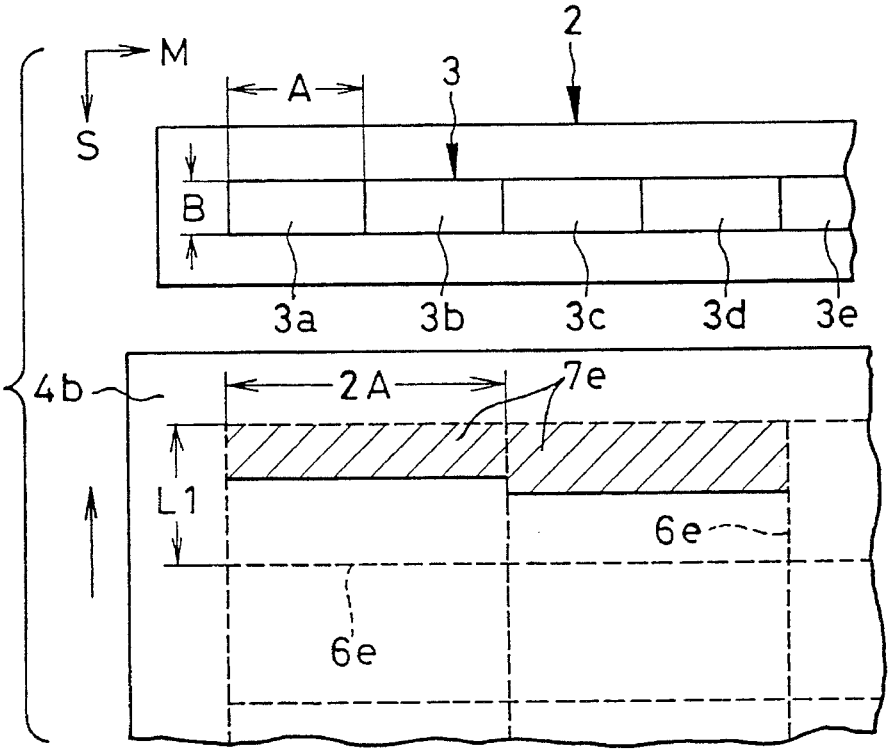
FIG. 10 is a schematic diagram of a thermal head and an example of a print having a pixel whose size is elongated only in the main scan direction, according to an embodiment of the invention.

FIG. 10 illustrates another embodiment in which image data is not thinned in the subsidiary scan direction S, i.e., no line is thinned. In the two-dot mode, the length of one print pixel **6*e* in the main scan direction M is 2**A, and that in the subsidiary scan direction S is L1, the same as the one-dot mode. In this case, image data is thinned every second data in one line, and the thinned image data is replaced by the remaining adjacent image data. Specifically, every second image data of one line is picked up and is written twice in the line memory, corresponding to two consecutive original pixel image data. In this embodiment, the size of a print pixel becomes large only in the main scan direction M, and the ink dot is correspondingly elongated in the main scan direction M. It is obvious that this embodiment is applicable to the three-dot mode and four-dot mode.

The present invention is applicable to a color line printer using ink films (including ink ribbons) of cyan, magenta, and yellow. The present invention is also a platen drum type color line printer and a reciprocal motion type color line printer. In the platen drum type, an image receiving paper is wound about a platen drum, and a three-color frame sequential print is carried out by three rotations of the platen drum. In the reciprocal motion type, an image receiving paper is reciprocally moved by a transport roller pair to perform a three-color frame sequential print. The present invention is also applicable to a serial printer as well as a line printer. In the serial printer, a thermal head moves in the subsidiary scan direction, and an image receiving paper moves in the main scan direction in one line. In a color serial printer, an image receiving paper reciprocates, for example, three times in one line to perform a three-color line sequential print.

Although the present invention has been described with reference to the preferred embodiments shown in the drawings, the invention should not be limited by the embodiments but, on the contrary, various modifications, changes, combinations and the like of the present invention can be effected without departing from the spirit and scope of the appended claims.

I claim:

1. A wax transfer type thermal transfer printing method for printing a half tone image, in which an ink film is overlaid on an image receiving paper and a back of the ink film is heated by a thermal head to transfer ink from the ink film to the image receiving paper to record one ink dot in one print pixel of the image receiving paper, a size of the ink dot being changeable in accordance with image data, the wax transfer type thermal transfer printing method comprising the steps of:

determining an image density of each area of said half tone image;

selecting one of at least a first pixel density mode and a second pixel density mode in accordance with said image density, said first pixel density mode having a pixel density larger than said second pixel density mode; and changing the size of the ink dot in accordance with said pixel density model, said second pixel density mode being selected for an image area having a low image density, said second pixel density mode having a larger size print pixel than said first pixel density mode.

2. The wax transfer type thermal transfer printing method according to claim 1, wherein said thermal head includes a heating element array having a plurality of heating elements disposed in a main scan direction, the image receiving paper and said thermal head being driven in relative motion to one another in a subsidiary scan direction perpendicular to said main scan direction by a predetermined pitch shorter than a length of said print pixel in said subsidiary scan direction, each of said heating elements being selectively driven by the image data, synchronously with the relative motion by said predetermined pitch.

3. The wax transfer type thermal transfer printing method according to claim 2, further comprising a third pixel density mode having a larger pixel density than said first pixel density mode, wherein if a smoothness of the image receiving paper is high, said third pixel density mode is selected independently of said image density, and if a smoothness of the image receiving paper is low, then one of said first and second pixel density modes is selected in accordance with said image density.

4. The wax transfer type thermal transfer printing method according to claim 3, wherein said image density is an average value of the image data of one line.

5. The wax transfer type thermal transfer printing method according to claim 3, wherein in said first pixel density mode, two consecutive heating elements are driven simultaneously; in said second pixel density mode, three consecutive heating elements are driven simultaneously; and in said third pixel density mode, each heating element is driven independently, thereby changing a length of the ink dot in said main scan direction with said pixel density.

6. The wax transfer type thermal transfer printing method according to claim 5, wherein said first pixel density mode comprises thinning every second image data of one line, multiplying image data remaining after thinning every second image data by two to provide first multiplied image data and using the first multiplied image data instead of adjacent thinned image data, said second pixel density mode comprises thinning two of every three image data in one line, multiplying image data remaining after thinning two of every three image data by three to provide second multiplied image data and using the second multiplied image data instead of two adjacent thinned image data, and said third pixel density mode comprises using image data of one line for printing without thinning.

7. The wax transfer type thermal transfer printing method according to claim 6, wherein in said first pixel density mode, the image data of one of two adjacent lines are used for printing and in said second pixel density mode, the image data of one of three adjacent lines are used for printing, to thereby change said pixel density in said subsidiary scan direction.

8. A wax transfer type thermal transfer printing method for printing a half tone image, in which an ink film is overlaid on an image receiving paper and a the back of the ink film is heated by a thermal head to transfer ink from the ink film to the image receiving paper to record one ink dot in one print pixel of the image receiving paper, the thermal head including a heating element array having a plurality of heating elements disposed in line in a main scan direction and moving relative to the image receiving paper in a subsidiary scan direction perpendicular to the main scan direction, a size of the ink dot being changeable in said subsidiary scan direction in accordance with image data the wax transfer type thermal transfer printing method comprising the steps of:

selecting one of at least a first print mode and a second print mode, said first print mode being used for image receiving paper having a smooth image receiving surface and said second print mode being used for image receiving paper having a rough image receiving surface, printing being performed in a first pixel density mode in said first print mode;

said second print mode includes the steps of determining an average value of the image data of at least one line;

judging whether said average value is equal to a reference value; and selecting one of at least a second pixel density mode and third pixel density mode in accordance with said judgment result, said second pixel density mode having a pixel density smaller than said first pixel density mode and being used when said average value is larger than said reference value, said third pixel density mode having a pixel density smaller than said second pixel density mode and being used when said average value is equal to or less than said reference value the size of said print pixel and the size of the ink dot being larger when said pixel density is small.

9. The wax transfer type thermal transfer printing method according to claim 8, wherein said pixel density is a number of print pixels per unit length in said main scan direction a length of the ink dot in said main scan direction changing in accordance with said pixel density.

10. The wax transfer type thermal transfer printing method according to claim 9, wherein in said first print mode, each of said heating elements of said heating element array is driven independently; in said second pixel density mode, said heating element array is grouped into sets of two adjacent heating elements and each set is driven simultaneously; and in said third pixel density mode, said heating element array is grouped into sets of three adjacent heating elements and each set is driven simultaneously.

11. The wax transfer type thermal transfer printing method according to claim 10, wherein said first pixel density mode comprises using the image data of one line for printing without thinning, said second pixel density mode comprises thinning every second image data of one line, multiplying image data remaining after thinning every second image data by two to provide first multiplied image data and using the first multiplied image data instead of adjacent thinned image data, and said third pixel density mode comprises thinning two of every three image data in one line, multiplying image data remaining after thinning two of every three image data by three to provide second multiplied image data and using the second multiplied image data instead of two adjacent thinned image data.

12. The wax transfer type thermal transfer printing method according to claim 11, wherein in said second pixel density mode, the image data of one of two adjacent lines is used for printing, and in said third pixel density mode, the image data of one of three adjacent lines is used for printing, to thereby change said pixel density in said subsidiary scan direction.

13. A wax transfer type thermal transfer printer for printing a half tone image, in which an ink film is overlaid on an image receiving paper and a back of the ink film is heated by a thermal head to transfer ink from the ink film to the image receiving paper to record one ink dot in one print pixel of the image receiving paper, the thermal head including a heating element array having a plurality of heating elements disposed in line in a main scan direction and moving relative to the image receiving paper in a subsidiary scan direction perpendicular to the main scan direction, a size of the ink dot being changeable in the subsidiary scan direction in accordance with image data, the wax transfer type thermal transfer printer comprising:

means for inputting a type of image receiving paper to be used;

means for selecting one of at least a first print mode and a second print mode in accordance with the input type of image receiving paper, said first print mode being used for image receiving paper having a smooth image receiving surface and said second print mode being used for image receiving paper having a rough image receiving surface, said means for selecting being coupled to said means for inputting;

first control means, coupled to said means for selecting, for directing printing at a first pixel density when said first print mode is selected;

means for determining an average value of said image data of at least one line when said second print mode is selected, said means for determining being coupled to said means for selecting;

means for judging whether said average value is equal to a reference value, said means for judging being coupled to said means for determining; and second control means, coupled to said means for judging, for selecting one of at least a second pixel density and a third pixel density in accordance with said judgment result, said second pixel density being smaller than said first pixel density and being used when said average value is larger than said reference value, said third pixel density being smaller than said second pixel density and being used when said average value is equal to or less than said reference value, a size of said print pixel and the size of the ink dot being larger when said pixel density is small.

* * * * *